United States Patent [19]

Savage et al.

[11] Patent Number: 4,592,423

[45] Date of Patent: Jun. 3, 1986

[54] HYDROCARBON STRATUM RETORTING MEANS AND METHOD

[75] Inventors: Kerry D. Savage; Hans J. Paap, both of Houston, Tex.

[73] Assignee: Texaco Inc., White Plains, N.Y.

[21] Appl. No.: 610,072

[22] Filed: May 14, 1984

[51] Int. Cl.[4] ..... E21B 43/24

[52] U.S. Cl. ..... 166/248; 166/60

[58] Field of Search ..... 166/248, 60, 65 R, 302, 166/245, 272, 50, 52

[56] References Cited

U.S. PATENT DOCUMENTS

| | | | |
|---|---|---|---|
| 4,144,935 | 3/1979 | Bridges et al. | 166/248 |
| 4,301,865 | 11/1981 | Kasevich et al. | 166/60 X |
| 4,470,459 | 9/1984 | Copland | 166/248 |
| 4,485,869 | 12/1984 | Sresty et al. | 166/248 |

*Primary Examiner*—Stephen J. Novosad

*Attorney, Agent, or Firm*—Robert A. Kulason; James J. O'Loughlin; Ronald G. Gillespie

[57] ABSTRACT

The system and the method of the present invention for the in-situ retorting of a hydrocarbon stratum, having a borehole traversing it, with electrical energy at a radio frequency (hereinafter referred to as rf energy) includes apparatus for conducting the rf energy from an rf energy source down a borehole. The apparatus has an outer conductor and inner conductor. A first plurality of electrodes is inserted into the hydrocarbon stratum. A second plurality of electrodes spatially related to the first plurality of electrodes, is also inserted into a hydrocarbon stratum. A first conductive device makes contact between the outer conductor of the apparatus and the first plurality of electrodes. A second conductive device makes electrical contact between the inner conductor of the apparatus and the second plurality of electrodes so that when the rf source provides the rf energy, the rf energy is applied acorss that portion of the hydrocarbon stratum between the two pluralities of electrodes.

19 Claims, 2 Drawing Figures

HYDROCARBON STRATUM RETORTING MEANS AND METHOD

BACKGROUND OF THE INVENTION

Field of the Invention

The present invention relates to the retorting of hydrocarbon material in general and, more particularly, to the in-situ rf retorting of a hydrocarbon stratum.

SUMMARY OF THE INVENTION

The system and the method of the present invention for the in-situ retorting of a hydrocarbon stratum, having a borehole traversing it, with electrical energy at a radio frequency (hereinafter referred to as rf energy) includes apparatus for conducting the rf energy from an rf energy source down a borehole. The apparatus has an outer conductor and inner conductor. A first plurality of electrodes is inserted into the hydrocarbon stratum. A second plurality of electrodes spatially related to the first plurality of electrodes, is also inserted into a hydrocarbon stratum. A first conductive device makes contact between the outer conductor of the apparatus and the first plurality of electrodes. A second conductive device makes electrical contact between the inner conductor of the apparatus and the second plurality of electrodes so that when the rf source provides the rf energy, the rf energy is applied across that portion of the hydrocarbon stratum between the two pluralities of electrodes.

The foregoing and other objects and advantages of the invention will appear more fully hereinafter from the consideration of the detailed description which follows, taken together with the accompanying drawings wherein one embodiment of the present invention is illustrated by way of example. It is to be expressly understood, however, that the drawings are for illustration purposes only and are not to be construed as defining the limits of the invention.

DESCRIPTION OF THE INVENTION

Figure 1:
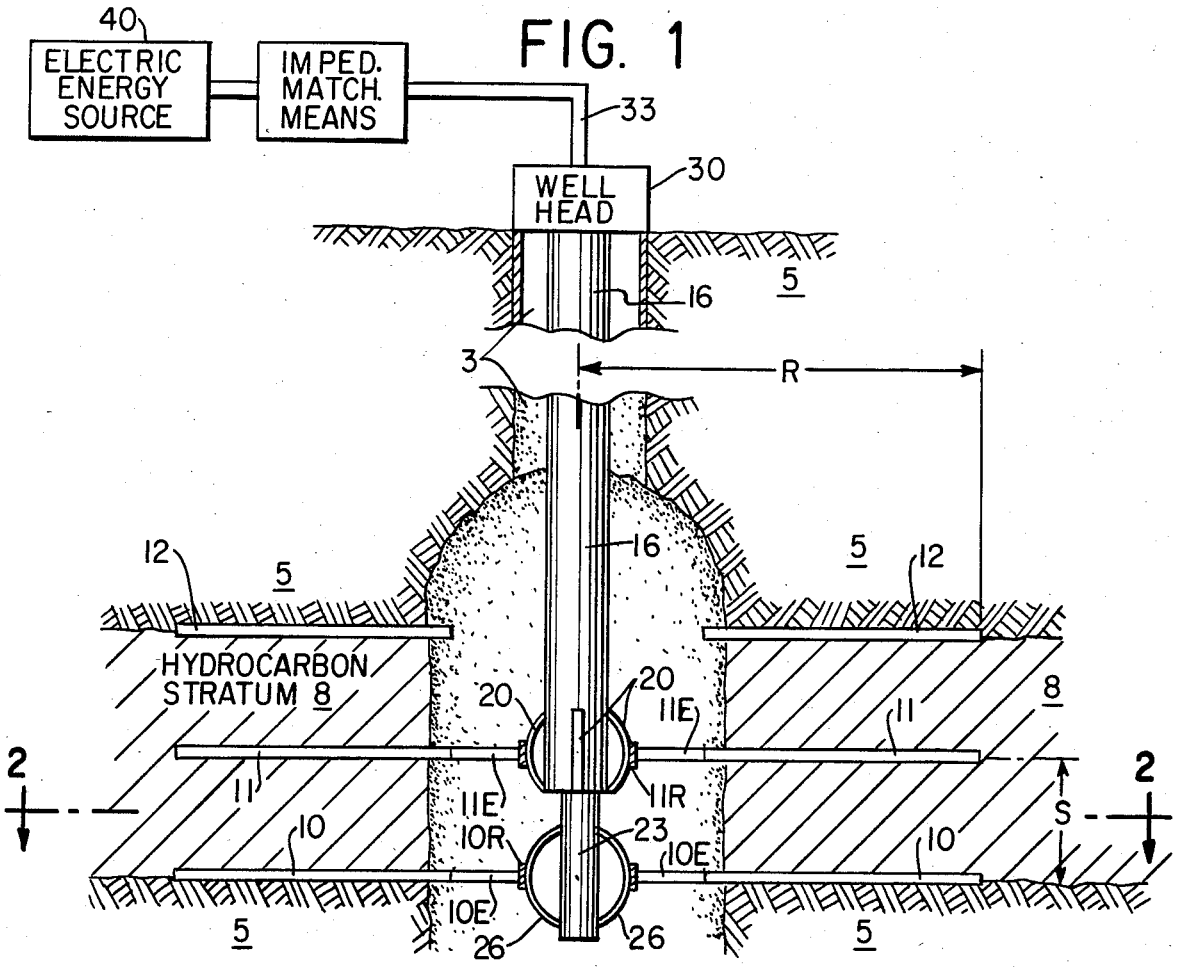
FIG. 1 is a graphical representation of an rf hydrocarbon stratum retorting system constructed in accordance with the present invention.
Figure 2:
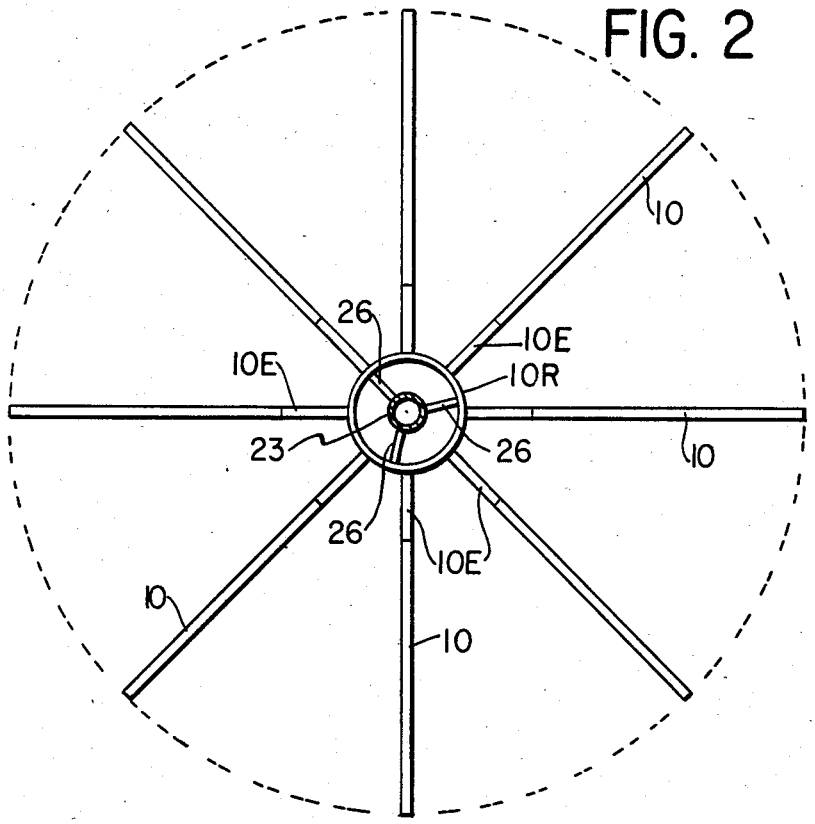
FIG. 2 is a graphical representation of a plurality of electrodes shown in FIG. 1.

With reference to FIG. 1, there is shown an in-situ rf energy retorting system for a hydrocarbon stratum, such as oil shale or tar sand. A borehole 3 is drilled into an earth formation 5 containing a hydrocarbon stratum 8. Borehole 3 in the vicinity of hydrocarbon stratum 8 is enlarged to enable maneuvering equipment for drilling of holes. Equipment in the initial preparation of the hole is used to drill lateral holes in a radial pattern, as shown in FIG. 2, from a center line of borehole 3 and in these holes are inserted electrodes 10, 11 and 12 which may be metal tubes. The difference in numeric identification of electrodes is to indicate the different levels of electrodes. As can be seen in FIG. 2, all of the electrodes in the lower layer bear the numeral 10. After the electrodes are inserted into the hydrocarbon stratum 8, extenders are either threaded or welded onto the electrodes at the near ends to present a uniform diameter for later connection to a conductive ring.

The electrode extenders have the same numeric designation, with a suffix E, as the electrodes they are connected to. Each ring is identified with the numeric designation, with a suffix R, as the electrodes that they are electrically connected to. It should be noted that there are no extenders shown for electrodes 12; this is to emphasize that in the initial insertion of the electrodes there must be sufficient room for a man to work. Extenders 10E are connected by a conductive ring 10R while extenders 11E are connected by a conductive ring 11R to assure electrical connections between all electrodes having the same number. Similarly electrode extenders 12E will be connected to a conductive ring 12R.

An outer conductor 16 has bow springs 20 connected to it to make electrical contact with a ring as hereinafter explained. An inner conductor 23 which may be hollow for the production of the retorted hydrocarbons, has bow springs 26 affixed thereto, to make electrical contact with the rings as hereinafter explained. Inner conductor 23 is kept separate from outer conductor 16 by ceramic spacers not shown. Conductors 16 and 23 are connected through a well head 30 to conducting means 33. Conducting means 33 is connected to impedance matching means 35, which is connected to a source of electric energy 40.

Two previous methods and apparatus for heating a hydrocarbon stratum with electromagnetic energy are exemplified by U.S. Pat. Nos. 4,140,180 and 4,301,865. The former requires complicated and expensive underground installation procedures, including a considerable amount of underground mining. However, it offers relatively uniform heating capability. The latter lends itself to simpler, cheaper installation procedures (no mining) but, unfortunately, does not offer as uniform a heating pattern. The relative uniformity of heating referred to here is inherent in the electromagnetic field patterns from the radiating electrode systems. The present invention offers good heating uniformity, as would be expected for U.S. Pat. No. 4,140,180, but with a system of electrodes which can be installed at less expense. The expected improved heating uniformity over U.S. Pat. No. 4,301,865 is very important in the overall energy efficiency and thus economics of the retorting process.

In the present invention one would select the distance between the levels of electrodes to be substantially smaller than the radial distance R from the center line of borehole 3 to the furthermost end of electrodes 10, 11 and 12. The distance R is substantially less than the wavelength $\lambda$ of the electromagnetic energy to be applied to hydrocarbon stratum 8. To express the preceding statements mathematically $$S << R \quad (1.)$$

$$R << \lambda \quad (2.)$$

The system of the present invention can operate in the rf frequency range. Obviously the lower the frequency, the longer the wavelength $\lambda$ in the media to be heated. As an example, for a frequency of 1 megahertz the wavelength $\lambda$ of the electrical energy in an oil shale formation is approximately 400 feet. Therefore the distance R from the center line to the extremity of the electrodes could be approximately 40 feet. The distance S between levels may be selected as 10 feet.

Bow springs 20 and 26 not only permit making electrical contact with the rings, but will also permit conductors 16 and 26 to be raised or lowered at the discretion of an operator.

Again with reference to FIG. 1, it can be seen that with electrodes 12 properly connected as explained for electrodes 10 and 11, the hydrocarbon stratum 8 between electrodes 10 and 11 would be heated and then conductors 16 and 23 are moved up so that bow springs 26 are in contact with ring 11R and bow springs 20 are in contact with ring 12R which permits the heating of the hydrocarbon stratum between electrodes 11 and 12. In one phase of operation the operator may alternately heat the different stratums merely by moving the conductors 16 and 23 up and down in the borehole.

Further, FIG. 1 shows three levels of electrodes. However, hydrocarbon stratum 8 may vary in thickness and the thicker it is the more levels of electrodes may be used.

To further enhance the recovery of hydrocarbons, electrodes 10, 11 and 12 and electrode extenders 10E, 11E and 12E may be perforated.

The present invention is not restricted to a radial pattern of electrodes, but may be used with any pattern of electrodes including a rectangular if so desired.

The present invention as hereinbefore described is a system and method of retorting a hydrocarbon stratum in-situ with rf energy.

What is claimed is:

1. A system for in-situ retorting of a hydrocarbon stratum, having a borehole traversing it, with RF energy comprising:

source means for providing RF energy;

means connected to said source means and having an outer conductor and an inner conductor for conducting the RF energy from the source means downhole;

a first plurality of electrodes, inserted into said hydrocarbon stratum and arranged in a radial pattern;

first connecting means for commonly connecting the first plurality of electrodes;

a second plurality of electrodes inserted into said hydrocarbon stratum, spatially related to said first plurality of electrodes in a predetermined manner, and arranged in a radial pattern;

second connecting means for commonly connecting the second plurality of electrodes;

first contact means, affixed to the outer conductor of the conducting means and adapted to pass through any connecting means, for making electrical contact between the outer conductor of the conducting means and the first connecting means; and second contact means, affixed to the inner conductor of the conducting means and adapted to pass through any connecting means, for making electrical contact between the inner conductor of the conducting means and the second connecting means so that the rf energy is applied across that portion of the hydrocarbon stratum between the two pluralities of electrodes.

2. A system as described in claim 1 where the furthermost point of an electrode, in either plurality of electrodes, from the center line of the borehole is a distance R and is substantially less than the wavelength λ of the rf energy in the hydrocarbon stratum.

3. A system as described in claim 2 where the distance R is one-tenth of the wavelength λ.

4. A system as described in claim 2 where a distance S between the pluralities of electrodes is substantially less than the distance R.

5. A system as described in claim 4 where the distance S is one-fourth of the distance R.

6. A system as described in claim 1 in which each contact means includes at least one metal bow ring affixed to a corresponding conductor.

7. A system as described in claim 6 in which each connecting means is a ring conductor connected to each electrode in a corresponding plurality of electrodes and having an inner diameter sufficient to allow the bow springs to pass through the ring conductor and yet make contact with the ring conductor.

8. A system as described in claim 6 where the pattern of electrodes of each plurality of electrodes is rectangular.

9. A system as described in claim 1 further comprising at least one additional plurality of electrodes embedded in the hydrocarbon stratum in a radial pattern, the distance between any additional plurality of electrodes and the nearest plurality of electrodes is substantially the same as the distance between the first and second pluralities of electrodes, and the length of the electrodes in any additional plurality of electrodes is substantially the same as the length of the electrodes in the first and second electrodes.

10. A system as described in claim 9 where the furthermost point of an electrode, in each plurality of electrodes, from the center line of the borehole is a distance R and is substantially less than the wavelength λ of the rf energy in the hydrocarbon stratum.

11. A system as described in claim 10 where the distance R is one-tenth of the wavelength λ.

12. A system as described in claim 11 where each distance between pluralities of electrodes is a distance S and is substantially less than the distance R.

13. A system as described in claim 12 where the distance S is one-fourth of the distance R.

14. A system as described in claim 9 in which each contact means includes at least one metal bow ring affixed to a corresponding conductor.

15. A system as described in claim 14 in which each connecting means is a ring conductor connected to each electrode in a corresponding plurality of electrodes and having an inner diameter sufficient to allow the bow springs to pass through the ring conductor and yet make contact with the ring conductor.

16. A method for the in-situ retorting of a hydrocarbon stratum, having a borehole traversing it, with rf energy comprising the steps of:

providing rf energy, conducting the rf energy down the borehole; and applying the rf energy in the borehole to two pluralities of electrodes, each plurality of electrodes being arranged in a radial pattern and spatially related to each other such that one plurality of electrodes is separated from the other plurality of electrodes by a distance S which is substantially smaller than a distance R from the center line of the borehole to the end of an electrode furthermost from the center line of the borehole which are inserted into the hydrocarbon stratum so that the rf energy is applied across that portion of the hydrocarbon stratum between the two pluralities of electrodes.

17. A method as described in claim 16 in which the conducting step includes conducting the rf energy down the borehole by way of an outer conductor and an inner conductor; and the applying step includes inserting the pluralities of electrodes into said hydrocarbon stratum in a predetermined manner electrically connecting the outer conductor to one plurality of electrodes, and electrically connecting the inner conductor to the other plurality of electrodes.

18. A method as described in claim 17 where each electrode has a length that is substantially less than the wavelength λ of the rf energy in the hydrocarbon stratum.

19. A method as described in claim 18 in which the distance between the pluralities of electrodes is substantially less than the length of the electrode.

* * * * *